United States Patent [19]

Atkinson

[11] 4,396,470

[45] Aug. 2, 1983

[54] LITHOGRAPHIC PRINTING PLATES

[75] Inventor: Philip A. Atkinson, Leeds, England

[73] Assignee: Vickers P.L.C., London, England

[21] Appl. No.: 349,194

[22] Filed: Feb. 17, 1982

[51] Int. Cl.[3] ..... C25D 11/12; C25D 11/08; C25D 11/18

[52] U.S. Cl. ..... 204/38 A; 204/42; 204/58; 101/459

[58] Field of Search ..... 204/42, 58, 38 A, 38 R; 101/459

[56] References Cited

U.S. PATENT DOCUMENTS

| | | | |
|---|---|---|---|
| 3,808,000 | 4/1974 | Magnotta et al. | 96/35 |
| 3,834,998 | 9/1974 | Watanabe et al. | 204/33 |
| 3,929,591 | 12/1976 | Chu et al. | 204/17 |
| 3,940,321 | 2/1976 | Adams | 204/58 |
| 4,049,504 | 9/1970 | Chu et al. | 204/58 |
| 4,188,270 | 2/1980 | Kataoka | 204/42 |
| 4,229,266 | 10/1980 | Usbeck | 204/42 |

FOREIGN PATENT DOCUMENTS

| | | | |
|---|---|---|---|
| 3175 | 7/1974 | European Pat. Off. | 204/58 |
| 7233 | 1/1980 | European Pat. Off. | 204/58 |
| 7234 | 1/1980 | European Pat. Off. | 204/58 |
| 8440 | 3/1980 | European Pat. Off. | 204/58 |
| 2729391 | 12/1971 | Fed. Rep. of Germany | 204/58 |
| 2548177 | 10/1975 | Fed. Rep. of Germany | 204/58 |
| 2522926 | 4/1976 | Fed. Rep. of Germany | 204/58 |
| 2557222 | 6/1977 | Fed. Rep. of Germany | 204/58 |
| 2331360 | 3/1971 | France | 204/58 |
| 418498 | 6/1950 | United Kingdom | 204/58 |
| 638321 | 6/1950 | United Kingdom | 204/58 |
| 704953 | 3/1954 | United Kingdom | 204/58 |
| 714078 | 8/1954 | United Kingdom | 204/58 |
| 776371 | 6/1957 | United Kingdom | 204/58 |
| 914834 | 5/1964 | United Kingdom | 204/58 |
| 958488 | 5/1964 | United Kingdom | 204/58 |
| 1097356 | 1/1968 | United Kingdom | 204/58 |
| 1201641 | 8/1970 | United Kingdom | 204/58 |
| 1204250 | 9/1970 | United Kingdom | 204/58 |
| 1224226 | 3/1971 | United Kingdom | 204/58 |
| 1410768 | 10/1975 | United Kingdom | 204/58 |
| 1240577 | 6/1977 | United Kingdom | 204/58 |
| 1532235 | 11/1978 | United Kingdom | 204/58 |

*Primary Examiner*—R. L. Andrews

*Attorney, Agent, or Firm*—Finnegan, Henderson, Farabow, Garrett & Dunner

[57] ABSTRACT

Aluminium sheets for lithographic printing plate production are anodized firstly in a phosphoric acid electrolyte and secondly in an electrolyte containing a major amount of phosphoric acid and a minor amount of sulphuric acid.

7 Claims, No Drawings

LITHOGRAPHIC PRINTING PLATES

This invention relates to treating aluminium and alloys thereof, in particular for use as substrates for lithographic printing plates.

Aluminium and aluminium alloys are the materials most commonly used as substrates for lithographic plates due to their relative cheapness, ductility, dimensional stability and the ability of the surface to be treated to improve its lithographic properties. Thus, it is common practice to grain the surface to increase its water holding capacity and improve the adhesion of the radiation sensitive coating used to form the image and to anodise the surface to increase its abrasion resistance and hydrophilic nature. The most commonly used electrolytes for the anodising process are phosphoric acid and sulphuric acid.

The use of phosphoric acid as anodising electrolyte produces an anodic layer which has a maximum thickness of only 1 micron due to the fact that the layer dissolves in the electrolyte. Thus, the abrasion resistance is relatively low.

The anodic layer produced using sulphuric acid as electrolyte is thicker, and therefore has better abrasion resistance, but is prone to staining and has inadequate adhesion to some types of light sensitive coating. Although the adhesion can be increased, in a few circumstances, by certain chemical post-anodising treatments both the anodising treatments and the chemical treatment have to be carefully controlled so that a balance between image adhesion and ease of development of non-image areas can be maintained consistently.

The production of improved aluminium or aluminium alloy substrates for lithographic printing plates has exercised the minds of those in the art for many years and to this end many different types of electrolytic treatment and many different types of electrolytes based on sulphuric acid, phosphoric acid and other conductive liquids have been tried. Surprisingly, it has now been found that anodic layers having excellent suitability for lithographic printing plates can be readily obtained merely by firstly anodising the aluminium or alloy thereof in phosphoric acid electrolyte and secondly anodising the aluminium or alloy thereof in an electrolyte comprising a mixture containing a major amount of phosphoric acid and a minor amount of sulphuric acid.

In accordance with one embodiment the first anodising is carried out for from 0.25 to 4 minutes using, as electrolyte, an aqueous solution containing 250–400 g/l (preferably 328 to 380 g/l) of phosphoric acid at a voltage of 15 to 35 V and a temperature of 15°–46° C. and the second anodising is carried out for from 0.25 to 4.0 minutes using, as the electrolyte, an aqueous solution containing 20–150 g/l (preferably 40 to 100 g/l) sulphuric acid and 250–380 g/l phosphoric acid at a voltage of 15–35 V and a temperature of 15–46 deg C.

According to a further preferred feature, the voltage used in the second anodising step is equal to or greater than the voltage used in the first step. Unless the voltages are arranged in this way, there is a delay whilst barrier layer thinning takes place before current can pass in the second anodising step.

The following Examples illustrate the invention.

EXAMPLE 1

Three sheets of electrochemically grained aluminium were anodised using direct current and respectively in phosphoric acid only (sheet 1), sulphuric acid only (sheet 2), and firstly in phosphoric acid and then in a mixture of phosphoric acid and sulphuric acid (sheet 3) using the following conditions:

| | | |
|---|---|---|
| Sheet 1 | | |
| Electrolyte: aqueous phosphoric acid. | Conc. | 396 $H_3PO_4$ per liter |
| | Temp. | 20 deg C. |
| | Voltage | 22 V |
| | Time | 3 mins. |
| Sheet 2 | | |
| Electrolyte: aqueous phosphoric acid. | Conc. | 160 g $H_2SO_4$ per liter |
| | Temp. | 15 deg C. |
| | Voltage | 22 V |
| | Time | 1 min |
| Sheet 3 | | |
| 1st Electrolyte: aqueous phosphoric acid. | Conc. | 380 $H_3PO_4$ |
| | Temp. | 20 deg C. |
| | Voltage | 30 V |
| | Time | 3 mins |
| 2nd Electrolyte: aqueous phosphoric acid/sulphuric acid mixture. | Conc. | 340 g $H_3PO_4$ per liter<br>60 g $H_2SO_4$ per liter |
| | Temp. | 20 deg C. |
| | Voltage | 30 V |
| | Time | 3 mins. |

The anodised sheets were coated with a radiation sensitive composition comprising the reaction product of p-diazodiphenylamine/formaldehyde condensate and sodium tri-isopropyl naphthalene sulphonate and Victoria Cyan F5G dye (BASF) to form radiation sensitive plates which were then exposed to UV light beneath a negative transparency and developed with 20% v/v aqueous solution of isopropanol containing 2% anionic surfactant. Each of the resultant lithographic printing plates was then used to print copies.

The sheet anodised in phosphoric acid only gave a print run of 60,000 copies before scumming due to the anodic layer being worn away in the non-image areas.

The non-image areas of the sheet anodised in sulphuric acid only were dye stained on development and the plate gave a print run of 60,000 copies before the image areas became worn due to lack of adhesion to the anodic layer.

The sheet anodised in two-stages in accordance with the present invention developed cleanly with no dye staining and gave a print run of 130,000 copies.

A further electrograined sheet was anodised in sulphuric acid only and then given a post anodic dip in sodium silicate. No improvement in either the degree of staining or the run length was found.

EXAMPLE 2

An aluminium web was continuously electrograined and then anodised using direct current firstly in phosphoric acid electrolyte and then in an electrolyte comprising a mixture of phosphoric and sulphuric acids. The web was then coated with the radiation sensitive composition of Example 1 to form a radiation sensitive plate.

The conditions used for the anodising were as follows:

| | | |
|---|---|---|
| 1st Electrolyte: aqueous phosphoric acid | Conc. | 328 g $H_3PO_4$ per liter |
| | Temp. | 43 deg C. |
| | Voltage | 29.5 V |
| | Time | 30 secs. |
| 2nd Electrolyte: aqueous phosphoric acid/ | Conc. | 312 g $H_3PO_4$ per liter<br>77 g $H_2SO_4$ per liter |
| | Temp | 40.5 deg C. |

-continued

| | | |
|---|---|---|
| sulphuric acid mixture | Voltage | 29.5 V |
| | Time | 30 secs. |

A sample of the web was exposed and developed as in Example 1. It developed cleanly and the resultant lithographic printing plate gave a print-run of 130,000 copies.

EXAMPLE 3

Three aluminium sheets were electrochemically grained and anodised as in Example 1.

The sheets were coated with a radiation sensitive composition comprising an epoxy resin ester of 4-azido-alpha-cyano-delta-chloro-cinnamylidene acetic acid to form radiation sensitive plates which were then exposed beneath a negative transparency to UV light and developed with a mixture of 2-ethoxy ethanol, 2-ethoxy ethyl acetate and a non-ionic surfactant. The resultant lithographic printing plates were then used for printing.

The sheets anodised in one acid only gave print runs of 60,000 copies whereas the sheet anodised in two stages in accordance with the present invention gave a print run of 120,000 copies.

A further sheet of electrograined aluminium was anodised in sulphuric acid under the above conditions and then given a post anodic treatment with hydrofluorosilicic acid. A print run of 120,000 copies was obtained, but unless the post anodic treatment was carefully controlled within very tight limits, removal of the non-image areas of the developer was rendered impossible.

EXAMPLE 4

Three further aluminium sheets were electrochemically grained and anodised as in Example 1.

The sheets were coated with a radiation sensitive composition comprising a quinone diazide ester, a novolak resin and a crystal violet dye to form radiation sensitive plates which were exposed to ultra-violet light beneath a positive transparency and developed with an aqueous solution containing sodium metasilicate, sodium phosphate and a non-ionic surfactant. Each of the resultant lithographic printing plates was then used for printing.

A print run of 120,000 copies was obtained from the sheet anodised in two stages in accordance with the present invention whereas the sheet anodised in phosphoric acid only gave 80,000 copies and the sheet anodised in sulphuric acid only gave 120,000 copies but had badly stained non-image areas.

EXAMPLE 5

Three further aluminium sheets were electrochemically grained and anodised as in Example 1.

The sheets were coated with a radiation sensitive composition as disclosed in Example 5 of British Patent Application No. 8,040,090 (2,069,997A) and exposed and developed as in that Example.

Results similar to those of Example 4 were obtained.

I claim:

1. A method of treating aluminium or an alloy thereof for use as a substrate in lithographic printing plate production which comprises firstly anodising it in phosphoric acid electrolyte and secondly anodising it in an electrolyte comprising a mixture containing a major amount of phosphoric acid and a minor amount of sulphuric acid.

2. A method according to claim 1 wherein the first anodising is carried out for from 0.25 to 4.0 minutes, at a voltage of from 15 to 35 V, at a temperature of from 15° to 46° C., and using an electrolyte containing from 250 to 400 g/l phosphoric acid.

3. A method according to claim 2 wherein the electrolyte used in the first anodising contains from 328 to 380 g/l phosphoric acid.

4. A method according to claim 1 wherein the second anodising is carried out for from 0.25 to 4.0 minutes, at a temperature from 15° to 46° C., and using an electrolyte containing from 20 to 150 g/l sulphuric acid and from 250 to 380 g/l phosphoric acid.

5. A method according to claim 4 wherein the electrolyte used in the second anodising contains at least 40 g/l sulphuric acid.

6. A method according to claim 1 wherein the voltage used in the second anodising is equal to or greater than the voltage used in the first anodising.

7. A method of manufacturing a radiation sensitive plate for lithographic printing plate production which comprises (i) anodising aluminium or aluminium alloy using an electrolyte consisting essentially of aqueous phosphoric acid solution, (ii) anodising the aluminium or aluminium alloy using an electrolyte consisting essentially of a major amount of phosphoric acid, a minor amount of sulphuric acid, and water, and (iii) coating the anodised aluminium or aluminium alloy with a radiation sensitive composition to obtain the desired radiation sensitive plate.

* * * * *